United States Patent [19]

Garcia

[11] Patent Number: 4,748,912

[45] Date of Patent: Jun. 7, 1988

[54] MORTAR GRENADE

[75] Inventor: Jose G. Garcia, Vizcaysa, Spain

[73] Assignee: Esperanza y Cia, S.A, Spain

[21] Appl. No.: 864,008

[22] Filed: May 16, 1986

[30] Foreign Application Priority Data

Apr. 16, 1986 [ES] Spain ..... 554.028

[51] Int. Cl.[4] ..... F42B 11/22; F42B 13/28

[52] U.S. Cl. ..... 102/473; 102/372; 244/33

[58] Field of Search ..... 102/372, 373, 525, 287, 102/288, 289, 291, 482, 473, 374; 244/324–329, 33

[56] References Cited

U.S. PATENT DOCUMENTS

| | | | |
|---|---|---|---|
| 2,113,313 | 4/1938 | Brandt | 102/372 |
| 3,429,264 | 2/1969 | Oversohl et al. | 102/288 |
| 3,731,627 | 5/1973 | Donnei et al. | 102/373 |
| 3,765,620 | 10/1973 | Donnei et al. | 102/372 |
| 4,186,900 | 2/1980 | Loeb, Jr. | 244/324 |
| 4,413,567 | 11/1983 | Frostig | 102/525 |

FOREIGN PATENT DOCUMENTS

| | | | |
|---|---|---|---|
| 1301741 | 8/1969 | Fed. Rep. of Germany | 102/372 |

*Primary Examiner*—Harold J. Tudor
*Attorney, Agent, or Firm*—Lucas & Just

[57] ABSTRACT

A supersonic mortar grenade is disclosed. Such grenade has a front portion that possesses a first conical section which is tangential to a second ogival section. The second ogival section is tangential to a cylindrical center area. The cylindrical center area is tangential to a rear portion which is made up of a first convex section and a second concave section, the convex section being tangential to the concave section. The concave section of the rear is tangential to a cylindrical finned tail.

5 Claims, 1 Drawing Sheet

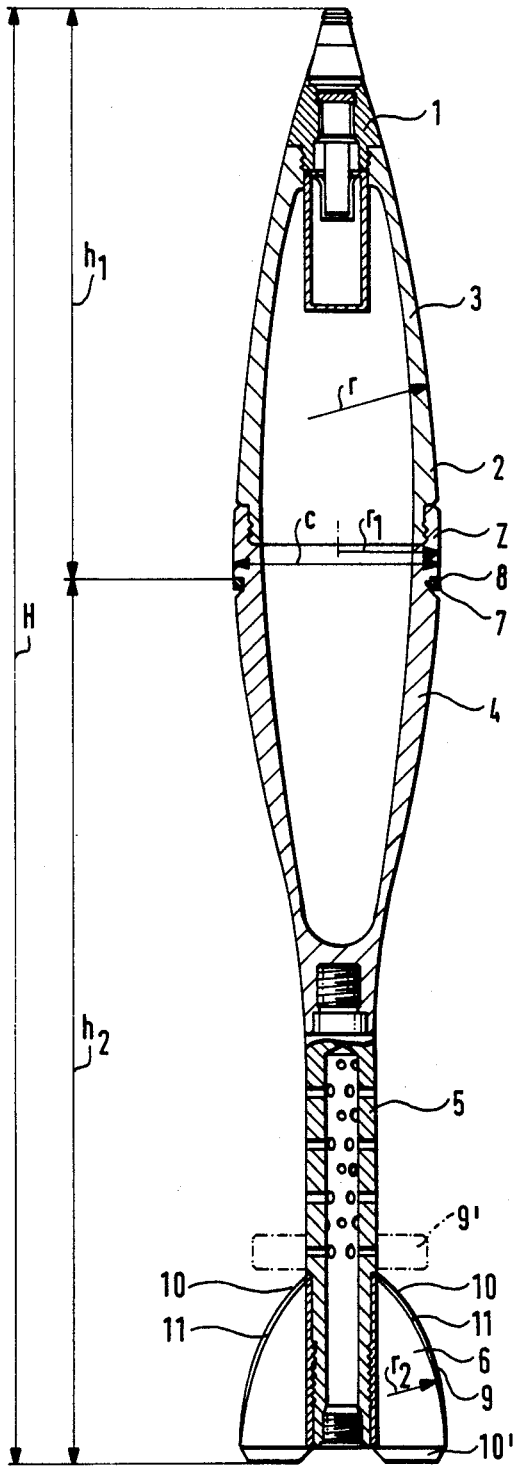
1
3
2
Z
8
7
4
5
9'
10
10
11
11
6
9
10'
h1
h2
H
r
r1
r2
c

MORTAR GRENADE

Smooth bore projectiles have up to now always been shaped in the form of a practically hemispherical ogival body with a small radius of curvature followed by a stabilizer tail which contained the projection cartridge on the rear of which was arranged the stabilizing fin, this normally being made from pieces of steel plate that were spot welded to said stabilizer tail.

These projectiles, used the world over, were subsonic and sufficed for the ranges that they were intended to cover, whilst in trajectory they gave rise to widely spread dispersions which were considered sufficient for firing ranges assigned to these weapons.

The grenade covered by this invention accomplishes the following purposes, which in turn are problems that at are at present found in known grenades:

1. To achieve a shape which offers the minimal amount of air resistance in order to achieve a ballistic coefficient such as to enable the longest ranges possible within the usual weights.

2. To achieve such stability as to prevent the well known classic rocking of winged projectiles in flight which eventually manifests itself in the form of excessively wide dispersion.

3. To provide a seal for the gases which emerge through the bourrelet, and thus make better use of the gas impulse and to achieve improved efficiency at firing for the same maximum pressure.

4. To achieve perfect ignition and combustion of the powder in the cartridge, and more efficient transmission and simultaneous ignition of the supplementary charges.

5. To accomplish even shattering and similar speeds in both ogive, body as well as bourrelet.

6. To obtain a body that will perfectly well withstand the high pressures that are required for the new supersonic speeds.

The mortar grenade covered by this invention is characterized because it is comprised of:

(a) a front portion, possessing a first conical section that is tangential to a second ogival section that is tangential to:

(b) a cylindrical bourrelet that is tangential to:

(c) a rear portion, possessing a first convex section that is tangential to a second concave section that is tangential to:

(d) a cylindrical finned tail.

It is also characterized because the second ogival section on the front section has a radius (r) on the circumference, and its ratio with respect to radius ($r_1$) of the bourrelet $r/r_1 > 8$.

It is also characterized because the height of the grenade (H) bears a ratio with respect to the diameter (c) of the bourrelet which is $6.4 \leqq H/c \leqq 7$.

It is also characterized because the fins are arranged radially upon the tail and diametrically opposed to one another in pairs, where the outside of the assembly comprising each pair is delta shaped.

It is also characterized because the shape of the delta is ogival with radius of circumference.

It is also characterized because the leading edge of each fin possesses a semi-circular shaped face and is joined by flats to the fin assembly.

It is also characterized because each fin possesses a rear extension terminating in the shape of a wedge.

It is also characterized because upon the bourrelet there is an expanding sealing ring with an overlapping wedge join at more than 120 degrees, which contains a channel made in the grenade and a flat supporting face.

It is also characterized because the grenade wall thickness at each section is substantially proportional to the grenade circular section radius.

It is also characterized because the grenade projection firing train, which serves the purpose of a primer and igniter, is comprised of an initiator capsule, a power intensifier, a homogenizing chamber and a bundle of thin threads of powder, thus enabling the fire to run without obstacles along the whole length of the cartridge.

It is also characterized because the ratio between the distance ($h_1$) from the sealing ring to the top of the grenade and the bourrelet diameter (c) is $2.4 \leqq h_1/c \leqq 2.7$.

It is also peculiar because the ratio between the ogival shaped circumference radius (r) and the radius ($r_1$) of the bourrelet is $r/r_1 > 13$.

FIG. 1 is a cross-section view of the grenade covered by the invention.

The projectile is comprised of ogive (3), rear section (4), tail (5) or stabilizing tube, and fins (6).

The shape adopted for the projectile ogive (3) is a tangential ogival cone in order to prevent oblique condensation forces from impinging upon the high pressure area as a result of the Mach lines when exceeding the speed of sound.

The conical section is comprised of the fuse (1) and it is identical for all calibers in order to enable the same fuse (1) to be used for all projectiles which is a great advantage as far as interchangeability and manufacture are concerned.

In order to keep a similar ogive (3) length in the family, this identicalness in the conical portion needs to be compensated by means of a variation in the radius of the ogival section (2) which thus possesses a smaller radius than it would have in proportion for the smaller calibres.

Notwithstanding this, variations in radius of the ogival section (2) on projectiles of the same family do not cause any significant variations in the resistance, because the resistance law for the ogival shape and the conical shape is practically one and the same for an elongated ogival.

When the theoretical calculation of the resistance (R) of a fluid to a revolving body in the direction of its axis is applied to an ogival cone shaped ogival and where the ogive radius is a circumference radius, then, all other factors being the same, the equation of comparison $$R = K\frac{4n-1}{12n^2}$$

is obtained, where $$n = \frac{r}{\frac{1}{2}c}$$

where, in turn, r is the radius of the circumference of the ogive, and c is the caliber of the projectile.

In view of the fact that the design of this projectile involves a much greater "r" than has ever been known up to now, it is seen in theory and proven on the range that the resistance is very much greater and achieves acceptable operation when $n \geqq 8$ and optimum performance when $n > 13$.

In practice, it has been found that in conjunction with the aforementioned factor (n), the projectile behaves optimally when the ratio between the ogive height ($h_1$) and the diameter (c) or caliber of $2.4 \leqq (h1/c) \leqq 2.7$ where the small area or bourrelet (Z) is included in this height of the ogive ($h_1$).

The rear body portion (4) adopts a sinusoidal (convex-concave) shape to prevent the fluid vein from becoming separated from the body and runs over its surface in a laminar fashion, linking with stabilizer tube (5) having a practically tangential curve so as to prevent oblique condensation forces from impinging from the Mach lines.

This shape of the rear portion moreover causes a shift forward of the projectile center of gravity which assists its stability, and this in turn is improved by the tail (5) being lengthened to such an extent that the sum of heights ($h_2$) of the rear body (4), tail (5) and fins (6) with respect to the diameter (c) or caliber of the projectile is $4 \leqq (h_2/c) \leqq 4.3$ which, in combination with the ogive (3) height, means that the ratio of the height (H) of the projectile assembly to its caliber (c) is $6.4 \leqq (H/c) \leqq 7$.

The projectile has been designed in order for the shrapnel to possess a perforating force that is similar in all areas of the projectile and in order that while withstanding the high pressures created at the time of firing, it has an even resistance profile with respect mainly to the rear area of the body.

The design as proven in practice, possesses a profile in which the wall thickness is proportional to the radius of the relevant circulation section, which is to say that the wall thickness diminishes to the extent that we move away above or below in correspondence with the small area (Z) having the maximum diameter and which is usually cylindrical, this being the bourrelet.

At the beginning of area (Z), there is adapted a sealing band (7) whose joint profile is an oblique cut with an overlap $>120°$.

Said band (7) is accommodated inside a flat fronted groove (8), and its normal contracted position means that said sealing band is held permanently in its housing.

Upon effecting front loading, the projectile will descend unimpeded into the tube since there is no sealing effect due to lack of any pressure.

Upon firing, the impeller gases will begin to emerge between the bourrelet and the cannon barrel, but when it is considered that in said area there is an acceleration of the gases similar to that which occurs in an annular nozzle, then under Pitot's laws, a depression is caused by such acceleration whereupon the band will expand and secure the seal thus preventing any gases escaping and allowing them to be used integrally for impelling the projectile.

The lengthening of the tail (5) provides for increased space to accommodate those supplementary charges (9') which may be necessary to give the projectile greater speed.

The lengthening of the tail (5) enables the stabilizing plume and its fins (6) to be placed further to the rear.

The old stabilizing plume made from welded steel plate has here been replaced by a mono-block unit in which the fins possess a symmetrical winged profile with a semicircular leading edge (9) followed by two leading flanks (11) which provide a weak pull to ensure stability with no rocking.

Each pair of fins is comprised of a delta-shaped plane with an ogivally-circular edge, the radius of whose circumference is ($r_2$) and this comprises the leading edge which gives a larger area than the triangular one while moreover the areas of greatest pressure have a larger slope on the leading edge which provides a compromise between improved stability and less resistance to advance.

Each fin (6) has a rear extension (10') that is also chamfered which, in conjunction with the shape described for fin (6), helps to locate the center of stabilizing forces further towards the rear and thus improve the stability.

In order to improve the ignition, the stabilizing tube (5) is built in a long narrow shape from high tensile light alloy, so that by virtue of Saint Venant's equation, a greater inside pressure is attained when, for a given load, there is a decrease in the inside diameter where it is located.

The difficulty that arises with the combustion of the powder in the cartridge (which plays the part of the fuse for the charge) is overcome by using powder in thin threads or straight tubes in a parallel position to the projectile axis. These threads are lighted by an initiating capsule containing lead trinitroresorcinate nitride or other initiating products whose firing is increased by a silicon-minimum, and these are contained within a conical space located in front of the bundle of threads or tubes of the ignition cartridge.

In this way, instantaneous ignition of the whole projection charge takes place, and it is characterized for its high degree of regularity in the initial velocities as the result of a minimal lengthwise dispersion.

I claim:

1. A mortar grenade comprising:

(a) a front portion, said front portion having a conical section and an ogival section, said conical section being tangential to said ogival section;

(b) a cylindrical center portion, said cylindrical center portion being tangential to said ogival section;

(c) a rear portion, said rear portion being tangential to said cylindrical center portion, said rear portion having a convex section and a concave section, said convex section being tangential to said concave section;

(d) a cylindrical finned tail, said tail being tangential to said concave section;

(e) delta fins mounted on said tail, said delta fins arranged in pairs diametrically opposed to one another, each delta fin having a radius of circumference and being ogival in shape;

(f) a caliber radius ($r_1$) measured at said cylindrical central portion and an ogival radius (r) measured at the circumference of said ogival section, such that said grenade has a first ratio of $r/r_1 > 8$;

(g) a first height (H) measured from tip to tail of said grenade such that said grenade has a second ratio of $6.4 \leqq H/2r_1 \leqq 7$;

(h) a second height ($h_1$) measured from the tip of said grenade to said cylindrical portion such that said grenade has a third ratio of $2.4 \leqq h_1/2r_1 \leqq 2.7$;

(i) a third height ($h_2$) measured from said cylindrical portion to tail of said grenade such that $h_1 + h_2 = H$ and such that said grenade has a fourth ratio of $4 \leqq h_2/2r_1 \leqq 4.3$; and (j) each portion of said grenade has a wall thickness at a point substantially proportional to a circular radius of said portion at said point.

2. The mortar grenade in accordance with claim 1 wherein each fin has a leading edge, said leading edge having a semi-circular shaped face and is joined by flats to the fin.

3. The mortar grenade in accordance with claim 1 wherein each fin has a rear extension, said extension terminating in the shape of a wedge.

4. The mortar grenade in accordance with claim 1 wherein the cylindrical center portion contains a channel made circumferentially around the grenade and said channel has a flat supporting face; and an expanding sealing ring positioned in said channel with an overlapping wedge join at more than 120 degrees.

5. The mortar grenade in accordance with claim 1 wherein the ratio between (r) and ($r_1$) is: $r/r_1 > 13$.

* * * * *